US011293248B2

(12) United States Patent
Sæther et al.

(10) Patent No.: US 11,293,248 B2
(45) Date of Patent: Apr. 5, 2022

(54) WELLHEAD ASSEMBLY INSTALLATION

(71) Applicant: EQUINOR ENERGY AS, Stavanger (NO)

(72) Inventors: Morten Sæther, Lillestrøm (NO); Asle Eide, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/759,049

(22) PCT Filed: Oct. 28, 2018

(86) PCT No.: PCT/NO2018/050259
§ 371 (c)(1),
(2) Date: Apr. 24, 2020

(87) PCT Pub. No.: WO2019/083378
PCT Pub. Date: May 2, 2019

(65) Prior Publication Data

US 2021/0180424 A1 Jun. 17, 2021

(30) Foreign Application Priority Data

Oct. 26, 2017 (GB) ..... 1717634

(51) Int. Cl.
*E21B 33/035* (2006.01)

(52) U.S. Cl.
CPC ..... *E21B 33/035* (2013.01)

(58) Field of Classification Search
CPC ..... E21B 33/035
(Continued)

(56) References Cited

U.S. PATENT DOCUMENTS 3,050,117 A 8/1962 Haeber et al.
3,341,398 A * 9/1967 Nicolson ..... E21B 7/128 175/7
(Continued)

FOREIGN PATENT DOCUMENTS

CN 202451101 9/2012
NO 139231 10/1978
(Continued)

OTHER PUBLICATIONS

Office Action dated Dec. 22, 2020 in corresponding UK Patent Application No. 1817448.2.
(Continued)

*Primary Examiner* — Matthew Troutman
*Assistant Examiner* — Patrick F Lambe
(74) *Attorney, Agent, or Firm* — Wenderoth, Lind & Ponack, L.L.P.

(57) ABSTRACT

A wellhead assembly and a method of installing a wellhead assembly. The method includes providing a well casing; providing a wellhead support structure; locating and fixing the well casing in a hole in the waterbed, wherein when the well casing is located and fixed in the hole the wellhead support structure is located a distance above the waterbed so as to leave a gap between the surface of the waterbed and the underside of the wellhead support structure; and fixing the wellhead support structure onto the surface of a waterbed with a settable material by putting the settable material into the gap when in a non-solid state to provide a rigid connection between the waterbed and the underside of the wellhead support structure. The assembly is arranged so that bending moments applied to the wellhead assembly can be at least partially transferred to the waterbed via the wellhead support structure.

15 Claims, 9 Drawing Sheets

(58) Field of Classification Search
USPC ..... 166/368
See application file for complete search history.

(56) References Cited

U.S. PATENT DOCUMENTS

| | | | | |
|---|---|---|---|---|
| 3,672,447 | A * | 6/1972 | Kofahl | E21B 7/20 166/338 |
| 3,705,623 | A * | 12/1972 | van Eek | E21B 33/035 166/338 |
| 3,853,183 | A * | 12/1974 | Downs | E21B 7/12 175/5 |
| 3,885,623 | A | 5/1975 | Watkins et al. | |
| 4,220,421 | A * | 9/1980 | Thorne | E02D 27/52 405/211 |
| 4,260,289 | A * | 4/1981 | Moinard | E21B 33/038 405/169 |
| 5,029,647 | A | 7/1991 | Milberger et al. | |
| 5,971,076 | A | 10/1999 | Taylor et al. | |
| 10,287,840 | B2 * | 5/2019 | Strand | E21B 33/043 |
| 2014/0074113 | A1 | 3/2014 | Hakala et al. | |
| 2014/0374113 | A1 * | 12/2014 | Kebadze | E21B 41/08 166/338 |
| 2016/0186517 | A1 * | 6/2016 | Hopper | E21B 33/038 166/359 |
| 2016/0333641 | A1 * | 11/2016 | Ellison | E21B 7/20 |
| 2017/0130547 | A1 | 5/2017 | Bhatnagar et al. | |
| 2017/0183934 | A1 * | 6/2017 | Mathis | E21B 33/037 |

FOREIGN PATENT DOCUMENTS

| | | |
|---|---|---|
| WO | 96/06260 | 2/1996 |
| WO | 2009/093911 | 7/2009 |
| WO | 2009/148320 | 12/2009 |
| WO | 2011/018120 | 2/2011 |
| WO | 2012/140445 | 10/2012 |
| WO | 2014/202948 | 12/2014 |
| WO | 2016/085348 | 6/2016 |

OTHER PUBLICATIONS

Examination report dated Jun. 25, 2020 in corresponding UK Patent Application No. 1817448.2.
Examination report dated Mar. 18, 2020 in corresponding UK Patent Application No. 1817448.2.
International Search Report dated Dec. 13, 2018 in International (PCT) Application No. PCT/NO2018/050259.
GB Search Report dated Feb. 26, 2018 in corresponding GB Application No. 1717634.8.
GB Search Report dated Mar. 18, 2019 in corresponding GB Application No. 1817448.2.

* cited by examiner

WELLHEAD ASSEMBLY INSTALLATION

The invention relates to a wellhead assembly installation and wellhead assembly. The wellhead assembly and installation may be suitable for use in a location with hard soil.

A subsea wellhead assembly typically comprises a conductor casing that is fixed into the seabed. The conductor casing supports (among other parts) a wellhead on which further equipment can be located, such as a Christmas tree and/or a blowout preventer (BOP), which are connected to a riser that lead to the surface of the water.

The installation of the subsea wellhead assembly may comprise drilling a hole and cementing the conductor casing in the hole. Lateral forces acting on the Christmas tree, blowout preventer (BOP) and/or riser are transferred to the conductor casing.

U.S. Pat. Nos. 4,220,421 and 3,341,398 each disclose a subsea wellhead assembly with a conductor pipe cemented into the seabed in a traditional way. In each case virtually all bending moments applied to the wellhead will be transferred to the seabed via the conductor.

In extreme cases the forces acting on a wellhead that are transferred into a conductor casing can result in bending or even breaking of the conductor casing.

To minimise this risk it is known to provide a wellhead support structure to transfer at least a portion of the forces from the Christmas tree, blowout preventer (BOP) and/or riser to a well foundation or the seabed. However, for this to be effective there needs to be a strong and reliable interface between the wellhead support structure and the seabed.

The present invention provides a method of installing a wellhead assembly (i.e. a subsea wellhead assembly) on a waterbed (e.g. a seabed), the method comprising: providing a well casing (e.g. that is for being, or is, connected to a wellhead housing); providing a wellhead support structure; and fixing the wellhead support structure onto the surface of the waterbed, wherein the assembly is arranged so that bending moments applied to the wellhead assembly can be transferred (i.e. at least partially) to the waterbed via the wellhead support structure.

The method may comprise locating and fixing the well casing in a hole in the waterbed, wherein when the well casing is located and fixed in the hole the wellhead support structure is located a distance above the waterbed so as to leave a gap between the surface of the waterbed and the underside of the wellhead support structure.

The step of fixing the wellhead support structure onto the surface of a waterbed with a settable material may be by putting the settable material into the gap when in a non-solid state and allowing it to solidify to provide a rigid connection between the waterbed and the underside of the wellhead support structure.

By filling the gap between the surface of the waterbed and the underside of the wellhead support structure with the settable material to form a rigid connection therebetween, the assembly is arranged so that bending moments applied to the wellhead assembly are transferred to the waterbed via the wellhead support structure.

The present invention also provides a wellhead assembly (i.e. subsea wellhead assembly) comprising: a well casing connected to a wellhead housing, wherein the well casing is fixed into a waterbed (e.g. a seabed); and a wellhead support structure, wherein the wellhead support structure is connected to the wellhead housing and fixed onto the waterbed, wherein the wellhead support structure is arranged so that bending moments applied to the wellhead housing can be transferred (i.e. at least partially) to the waterbed via the wellhead support structure.

The wellhead support structure is designed to be able to accommodate the expected loads during operation of the wellhead assembly.

The wellhead support structure may be located a distance above the waterbed so as to provide a gap between the surface of the waterbed and the underside of the wellhead support structure. This may be achieved by using one or more mounts to hold the wellhead support structure a distance above the seabed to provide a gap thereunder. The mount may also be used to level the assembly, e.g. ensure that he well casing and/or well head is vertical, and/or the wellhead support structure is horizontal.

The wellhead support structure may be fixed onto the surface of the waterbed using a settable material that has been put into the gap when in a non-solid state and allowed to solidify to provide a rigid connection between the waterbed and the underside of the wellhead support structure.

Similarly, by the wellhead support being fixed by filling the gap between the surface of the waterbed and the underside of the wellhead support structure with the settable material to form a rigid connection therebetween, the assembly is arranged so that bending moments applied to the wellhead assembly are transferred to the waterbed via the wellhead support structure.

The below description of features, including optional features, is applicable to both the above method and assembly, as appropriate.

The wellhead support structure may be fixed onto the surface of the seabed with a settable material such as cement, i.e. grout. Thus, the wellhead support structure may be cemented onto the surface of the waterbed.

In a first aspect the present invention may provide a method of installing a wellhead assembly comprising a well casing and a wellhead support structure, the method comprising: providing the well casing; providing the wellhead support structure; locating and fixing the well casing in a hole in the waterbed, wherein when the well casing is located and fixed in the hole the wellhead support structure is located a distance above the waterbed so as to leave a gap between the surface of the waterbed and the underside of the wellhead support structure, and fixing the wellhead support structure onto the surface of a waterbed with a settable material by putting the settable material into the gap when in a non-solid state and allowing it to solidify to provide a rigid connection between the waterbed and the underside of the wellhead support structure, wherein the assembly is arranged so that bending moments applied to the wellhead assembly (e.g. a wellhead housing) can be at least partially transferred to the waterbed via the wellhead support structure.

In a second aspect the present invention may provide a wellhead assembly comprising: a well casing connected to a wellhead housing, wherein the well casing is fixed into a waterbed; and a wellhead support structure, wherein the wellhead support structure is connected to the wellhead housing, wherein the wellhead support structure is located a distance above the waterbed so as to provide a gap between the surface of the waterbed and the underside of the wellhead support structure, wherein the wellhead support structure is fixed onto the surface of the waterbed using a settable material that has been put into the gap when in a non-solid state and allowed to solidify to provide a rigid connection between the waterbed and the underside of the wellhead support structure, and wherein the wellhead support structure is arranged so that bending moments applied to the wellhead assembly (e.g. wellhead housing) can be at least partially transferred to the waterbed via the wellhead support structure.

The settable material may have been set/solidified when it is between the wellhead support structure and the seabed. The settable material may bond to the wellhead support structure and the seabed, i.e. form a rigid connection between the wellhead support structure and the seabed, such that bending moments applied to the wellhead housing can be at least partially transferred to the waterbed via the wellhead support structure.

The waterbed may be or comprise hard soil. Thus the waterbed may be one in which it is not possible to drive, suck or force components any significant distance (e.g. more than 20 cm, or more than 50 cm) into the seabed. For example, the waterbed may be one in which it is not possible to use a suction anchor. This is because the soil may be too hard to allow the suction anchor to be sucked into the seabed. Additionally or alternatively the soil may comprise obstructions such as boulders that mean that it is desirable to not have to use a suction anchor.

The waterbed may be one in which using a suction anchor is not feasible due to problems such as problems in achieving an acceptable level of verticality (e.g. a soil in which it is not possible to reliably achieve a verticality of less than 1.25 degrees or 2 degrees from vertical) and/or due to problems with washout.

The hard soil may be dense to very dense sand (e.g. density index of 65 to 100%) and/or high to extremely high undrained shear strength clay (e.g. undrained shear strength greater than 75 kPa). This may be as defined in the ISO standard 14688-2 2004.

Thus the assembly may not comprise a suction anchor and/or any other component that is forced into the waterbed. This may mean no component penetrates the waterbed to any significant extent, i.e. there is no component that penetrates more than 20 to 30 cm or more than 50 cm into the soil without a hole being formed first. There may be components such as a mould (e.g. sliding ring) and/or mount (e.g. hydraulic cylinders) that penetrate the waterbed slightly (e.g. up to 20 to 30 cm or up to 50 cm).

The method may comprise locating the well casing in a hole in the waterbed and locating the wellhead support structure above the surface of the waterbed. The locating of the wellhead support structure above the waterbed may leave the gap into which the settable material is provided so as to fill the gap. The method may comprise fixing the well casing in the hole with the wellhead support structure connected to the casing.

The step of locating the well casing in the hole in the waterbed may be performed before the step of fixing the well casing in the hole in the waterbed. There may be additional steps between the steps of locating and fixing the well casing in the hole. For example, the method may comprise the step of levelling the well casing, wellhead support and/or wellhead after the well casing has been located in the hole but before the well casing is fixed, e.g. cemented, in the hole.

The method may comprise one or more or all of the following steps: forming, e.g. drilling, a hole in the waterbed, providing a wellhead assembly comprising the well casing, and wellhead support structure (and optionally a wellhead housing) all connected (e.g. rigidly) together, locating the wellhead assembly so that the well casing is located in the hole in the waterbed and the wellhead support structure is located a distance above the waterbed (i.e. to leave a gap/volume between the underside of the wellhead support structure and the waterbed), fixing the well casing into the hole using a flowable settable material (e.g. cement), holding the well casing whilst the material solidifies, and fixing the wellhead support structure onto the surface of the waterbed using a flowable settable material between the support structure and the waterbed. This may be achieved by filling the gap between the underside of the wellhead support structure and the waterbed with the flowable settable material. The steps of the method may be performed in this order.

The method may comprise providing a well casing connected or for being connected to a wellhead housing.

The method may comprise forming a hole in the waterbed. This may be formed by drilling. The hole may be formed with no foundation or wellhead support on the waterbed around the hole. In particular, the hole may be formed before the wellhead support structure is fixed onto the waterbed. The dimensions of the hole may be standard dimensions used when drilling subsea oil wells, such as exploration wells. The hole may for example be a 42" hole if the wellhead casing has a diameter of 36" or a 36" hole if the wellhead casing has a diameter of 30".

The length of the hole may depend on the length of the casing being received in the hole. The hole for example may be 12 m or 24 m.

The wellhead support structure may be connected (directly or indirectly) to the wellhead housing and/or the well (e.g. conductor) casing. This may be a rigid connection. The wellhead support structure, wellhead housing and/or well casing may be rigidly connected and/or locked together. This may allow forces to be transferred from the wellhead housing to the wellhead support structure.

The wellhead support structure may surround the well casing and/or wellhead housing. This may allow forces to absorbed via the wellhead support structure irrespective of which direction they applied.

The wellhead support structure may be co axial with the well casing and/or wellhead housing.

The wellhead support structure may be connected to the well casing and/or wellhead housing before it is deployed subsea. The well casing may be connected to the wellhead support structure whilst the components are in a moon pool at or near the installation site. Connecting the parts at this stage may allow it to conveniently be ensured that a reliable connection is made between the components whilst making the transport of the parts easier and/or more efficient.

The wellhead support structure may be connected to the well casing and/or wellhead housing onshore. These parts may then be transported to the installation site when connected together.

The wellhead support structure and well casing may be lowered towards the seabed when connected together.

Alternatively, the wellhead support structure and well casing may be connected together subsea but before the well casing is fixed in the hole in the waterbed.

For example, the wellhead support structure and well casing may be lowered below sea when not connected. These components may then be connected subsea before the casing is fixed into the waterbed.

Thus the well casing and/or wellhead housing may be connected to the wellhead support structure when the components are onshore, on the vessel (e.g. at or near the installation site), in mid-water, or on seabed. In each case the components may be connected together before the casing is fixed into the seabed.

The method may comprise locating the well casing in the hole in the waterbed and locating the wellhead support above the surface of the waterbed.

There may be a gap between the waterbed and the underside of the wellhead support when the casing is being fixed.

The method may comprise using one or more mounts to locate the well casing in the hole in the waterbed and to locate the wellhead support above the surface of the seabed. The mounts may be used, e.g. at this stage, to level the assembly. This may be to ensure that the well casing and wellhead are vertical and/or the wellhead support structure is horizontal.

The wellhead support may not directly contact the waterbed. In operation any load transfer from the wellhead support to the waterbed may be via the settable material (i.e. once it has been solidified).

There may be direct contact between the settable material and the underside of the wellhead support and/or between the settable material and the surface of the waterbed underneath the wellhead support.

The method may comprise sealing the gap to provide a sealed volume underneath the wellhead support structure. For example, the method may comprise using a barrier to seal the gap to the sea bed so as to provide a volume into which the settable material may be provided.

The method may comprise fixing the well casing in the hole.

The fixing of the well casing in the hole may be rigidly fixing the well casing in the hole. The casing may be located in the hole and fixed in the hole using a settable material such as cement.

The wellhead support structure may be connected (directly or indirectly) to the well casing before the well casing is fixed into the hole. As a result, the step of fixing the well casing in the hole may be with the wellhead support structure connected to the casing. An indirect connection may be via the wellhead housing.

The settable material may be supplied into and set in the annulus between the outside of the well casing and the inside of the borehole.

The casing may be held whilst the settable material, e.g. cement/grout, is curing.

The casing may be held in a position, such as vertical (or within an acceptable tolerance of vertical such as 1.25 degrees or less from vertical), whilst it is being fixed in the hole. The wellhead support structure may be held in a position, such as horizontal, or within an acceptable tolerance of horizontal, whilst the casing is being fixed in the hole. The position of the casing and/or wellhead support structure may be a predetermined position or a set position relative to vertical and/or the waterbed.

The method may comprise locating the well casing in a hole in the waterbed, holding the well casing and/or wellhead support structure in a position whilst the well casing is in the hole, e.g. by means of one or more mounts, and then fixing the well casing in the hole.

The step of holding the well casing and/or wellhead support may comprise holding the wellhead support structure a distance above the waterbed so as to leave a gap between the surface of the waterbed and the underside of the wellhead support structure.

The wellhead support structure may be located a distance above the waterbed so as to leave a gap between the surface of the waterbed and the underside of the wellhead support structure by using a mount.

Holding the well casing and/or wellhead support may comprise adjusting the orientation/verticality/position of the well casing and/or wellhead support structure. This may for example be achieved using a mount (i.e. levelling device). Thus the method may comprise a levelling step.

The levelling step may be performed whilst the wellhead support structure is supported a distance above the waterbed. The levelling step may be before and/or while the casing and/or wellhead support structure are being fixed to the seabed.

The mount may ensure that there is a gap between the underside of the wellhead support structure and the seabed in which settable material can be provided, may be used to adjust the orientation/verticality of the assembly and/or hold the assembly stable relative to the seabed whilst a settable material solidifies between the well casing and the seabed and/or between the wellhead support structure and the seabed.

The holding step (e.g. by the mount) may be temporary, e.g. only during installation. The wellhead support structure may be held in position by the settable material once it has set.

The mounts may remain as part of the assembly after the fixing step (i.e. they are permanent) or they may be removed after the fixing step (i.e. they are recoverable).

The step of holding (e.g. with a mount/levelling device) may comprise holding the well casing and/or wellhead support structure steady. This may result in there being no or limited movement between the well casing and/or wellhead support structure and the waterbed whilst it is being fixed therein by a settable material. This may allow a reliable bond to be formed between the well casing and the hole by a settable material.

The assembly may comprise a means to secure the verticality of the assembly during installation.

The assembly may be held by a drill string whilst the settable material is solidifying.

The casing may be held in a position, such as vertical by providing one or more packers between the well casing and hole. The packer may be an inflatable packer. This may for example be filled with a liquid, such a seawater or cement, to hold the casing in a position such as vertical.

The packer may be a swell packer that expands when in contact with liquid such as seawater.

The packer may be provided over part of the length of the casing, such as a top part of the casing near the surface. The packer may be provided over the majority or all of the length of the casing in the borehole.

If the wellhead support structure is connected to the well casing whilst the casing is being fixed in the hole, additionally or alternatively, the well casing may be held in position (e.g. vertical) by holding the wellhead support structure.

This control of position may be achieved by providing a mount between the wellhead support structure and the waterbed. This may be an adjustable mount, i.e. a mount that can be adjusted to control the position/orientation of the wellhead casing and/or the wellhead support structure. The mount may for example be hydraulic jacks, sliding cylinders (i.e. hydraulic sliding cylinders), hydraulic feet (e.g. truck feet), levelling screws and/or a gimbal.

The mount may be referred to as a levelling device.

The mount/levelling device may be part of and/or extend through the wellhead support structure.

The assembly may comprise a plurality of mounts, e.g. adjustable mounts, such as levelling screws or hydraulic levelling cylinders. For example, there may be three, or four, or more mounts. The mounts may be distributed about the circumference of the well casing and/or wellhead support structure. For example the mounts may be equidistant around the well casing. For example in the case of three mounts they may be 120 degrees apart and in the case of four mounts they may be 90 degrees apart etc.

The mounts/levelling devices may extend within and/or outside the footprint of the wellhead support structure, i.e. they may extend underneath the wellhead support structure within the gap/void and/or they may be outside the outermost surface of the wellhead support structure outside of the gap/void.

Having the mounts within the footprint of the wellhead support structure has the advantages that this gives less footprint and simplifies transportation and installation.

The mounts may be adjustable by means of an ROV. The mounts may be adjustable remotely. The mounts may be individually adjustable. The mounts may be used to locate the wellhead support structure in a horizontal position. The mounts may be able to locate the wellhead support structure in a horizontal position when the seabed has an inclination/slope of up to 3 degrees.

One or more or each mount may have a pad at the lower end thereof that is designed in use to contact the waterbed. One or more or each pad may have gripper thereon, such as an uneven surface such as a bar, that prevents sliding of the pad on the waterbed. In other words, the gripper may increase the friction between the underside of the pad and the waterbed.

The diameter of the pads on the bottom of the mounts will depend on the geology of the waterbed and the expected forces to be applied whilst the mount is being used, e.g. the weight of the assembly. The diameter may for example be 0.5 to 1.5 m, such as 0.7 to 1 m or 0.7 m or 1 m.

The method may comprise fixing the wellhead support onto the surface of the waterbed.

The step of fixing the wellhead support structure onto the surface of the waterbed may comprise rigidly fixing the wellhead support structure onto the surface of the waterbed.

Fixing the wellhead support onto the surface of the waterbed may occur after the hole has been formed in the waterbed. This may minimise the risk of washout occurring underneath the wellhead support.

The installation sequence may minimise the risk of washout occurring during drilling of the well (e.g. further drilling after the well head support is fixed onto the seabed).

Fixing the wellhead support onto the surface of the waterbed may occur after the well casing has been fixed into the waterbed.

Further, if the wellhead support is fixed onto the surface of the waterbed with a flowable settable material such as cement, the material may fill any gaps, holes or crevices that have formed, e.g. due to washout, whilst the hole was being formed, e.g. drilled.

The well casing may be fixed into a hole in the waterbed with a settable material that has set before the wellhead support is fixed onto the surface of the waterbed with a flowable settable material. There may be two distinct steps of fixing the conductor in the hole with settable material and letting it solidify and then fixing the wellhead support onto the surface of the waterbed and letting it solidify. Alternatively, fixing the conductor in the hole and fixing the wellhead onto the surface of the waterbed may be done in one operation.

The method may comprise providing the settable material into the hole by passing the settable material through the well casing, e.g. conductor, and into the hole. The method may additionally comprise providing the settable material into the gap by passing the settable material through the well casing, e.g. conductor, up through the hole and into the gap. Thus the method may comprise providing a sufficient volume of settable material through the well casing to fill the hole in the seabed around the well casing and the gap/volume underneath the wellhead support structure, e.g. within the barrier.

The wellhead support structure may be fixed onto the surface of the waterbed after well casing has been fixed in the hole.

The wellhead support structure may be fixed onto the surface of the waterbed after the wellhead support structure has been connected (e.g. rigidly) to the wellhead housing and/or well casing.

The wellhead support structure may be fixed onto the surface of the waterbed after the casing is fixed into the seabed.

The term rigid as used herein may mean that the connection does not flex to any substantial degree under the normal forces experienced by the connection in use. The rigid connection may allow forces to be transferred between the components.

The wellhead support structure may be fixed onto the surface of the waterbed with a flowable settable material such as cement. This material may be located in the gap between the underside of the wellhead support structure and the surface of the waterbed. The settable material may fill the gap and be bonded to both the underside of the wellhead support structure and the surface of the waterbed.

The gap may be the void/volume underneath the well support structure, i.e. the volume bounded on the upper surface by the well support structure, on the lower side by the waterbed and on the outer side by the location in line with the outermost edge surface of the well support structure.

The material provided underneath the wellhead support structure may provide a bearing surface for loads to be transferred to the seabed.

When the well casing is located and fixed in the hole the wellhead support structure may be located a distance above the waterbed so as to leave a gap between the surface of the waterbed and the underside of the wellhead support structure.

The material, e.g. cement, may be put into, e.g. fill, the gap when in a non-solid state and allowed to solidify to provide a rigid connection between the waterbed and the underside of the wellhead support structure. The material may directly connect between the waterbed and the wellhead support structure. The material once set may provide a load path between the wellhead support structure and the waterbed. The load path may be able to take bending moments. These may be accommodated in compression and/or tension.

The method may comprise providing a barrier (e.g. a mould) to provide a bound volume between the surface of the waterbed and the support structure. The barrier may seal against the seabed to create a sealed volume underneath the wellhead support structure. If any openings remain between the barrier and the seabed these may be sealed by using additional sealing devices such as sandbags to cover the openings.

The settable liquid may be provided into this bound and/or sealed volume. This may be to ensure that the settable material, e.g. cement, can effectively fill this volume. This may ensure that a reliable bond is formed between the wellhead support structure and the waterbed.

There may be full contact between the settable material and the underside of the wellhead support structure. Thus, it may be ensured that there is a sufficient bearing capacity underneath the wellhead support structure to allow forces to be effectively transferred from the wellhead housing to the seabed via the support structure in addition to the well casing.

The barrier may be or comprise a ring (e.g. a cylinder or any other shape such as a ring with a square or irregular shaped cross section). The ring may be located around the well casing to form a volume that is bounded on the outside by the ring, on the inside by the well casing on the bottom by the upper surface of the waterbed and on the top by the underside of the wellhead support structure.

The ring may for example be a rigid, e.g. steel, skirt. The ring may have a height that is equal to, or less than, the height of the gap, this may for example be about 0.5 m.

The barrier may seal with the waterbed by penetrating the surface. This penetration may be only to a small extent e.g. only slightly such that it achieves a seal but not enough to secure the assembly to the seabed. This may for example occur when the surface of the water bed comprises a shallow layer of sand or mud.

If there is no or insufficient depth of soft layer at the surface, the barrier may be penetrated into the soil/sand through hydro-jetting at the tip so the barrier can penetrate the seabed slightly under the weight of the structure.

The ring may be a plastic, e.g. polyester, ring. This ring may be hard yet elastic. This has the advantage that it may be possible to seal against an uneven seabed to form the volume into which the settable material is provided.

The barrier may comprise an elastic tube that is for sealing with the surface of the waterbed.

The barrier comprise be a flexible skirt, such as strong plastic bag. The skirt may be weighted and/or sealed to the seabed at its lower end, for example by a chain ring and/or sand bags, so that it seals against the waterbed.

The barrier may be fixed, e.g. clamped, onto the wellhead support structure. For example it may be fixed to the outside surface of the wellhead support structure.

The barrier may be a sliding ring or small skirt at or near the outer perimeter of the wellhead support structure. The barrier may be a skirt on the underside of the wellhead support structure. When the wellhead support structure is located above the surface of the seabed the skirt may rest on the seabed to create the bound volume in which the settable material can be supplied.

The barrier may comprise one or more or all of the above alternative types of barriers. For example, it may comprise a rigid skirt in combination with a plastic ring and/or a flexible, weighted, skirt.

For example the rigid skirt may be fixed to the underside of the wellhead support structure and the flexible ring/skirt may be fixed to the bottom of the rigid skirt. The flexible ring/skirt may seal against the waterbed.

The volume within the barrier may be filled with the settable material whilst the wellhead support structure is supported by the one or more mounts.

The barrier may be an inflatable packer. This may be installed under the support structure to hold the settable material in place while curing.

The barrier may be adjusted, e.g. lowered or inflated, to form the volume.

The size of the volume may be determined (e.g. measured or estimated) and an appropriate volume of settable material may be provided to fill the volume and optionally any other voids it is desired to fill with the material.

The method may comprise fully filling the gap/volume underneath the wellhead support structure with the settable material. By fully filled it may mean that the volume is entirely filled with the settable material aside from unavoidable pockets of water and/or air or other trapped materials, i.e. the volume is filed with a settable material as fully as is achievable in a typical subsea operation.

The method may comprise verifying that the gap underneath the wellhead support structure is filled with the settable material. This may help to ensure that there is a reliable bond between the wellhead support structure and the waterbed so that forces can be effectively transferred from the wellhead support structure to the waterbed.

Verifying that the gap underneath the wellhead support structure has been filed may comprise checking that the settable material reaches and/or passes through a vent in the assembly from the gap.

The assembly may comprise one or more vents for checking that the gap/void underneath the wellhead support structure has been filled with settable material. The method may comprise providing settable material in the gap underneath the wellhead support structure (e.g. through the well casing as discussed above) until the settable is detected at one or more or all of the vent(s). The vent may for example be a dip stick hole in the wellhead support structure.

The vent(s) may also provide a path for fluid such as water and/or air to leave the sealed volume within the barrier as it is filled with the settable material.

These vent(s) and/or additional vents (e.g. back fill pipes) may be used to provide settable material into the gap. This may be instead of filling the gap with settable material that has passed through the well casing or in addition to providing settable material through the well casing, e.g. to top up the settable material in the gap.

Thus the vents may act as outlets and/or inlets to the gap.

The vents may extend through the wellhead support structure.

The vents may be distributed about the circumference of the well casing and/or wellhead support structure. For example the vents may be equidistant around the well casing. For example in the case of four vents they may be 90 degrees apart and in the case of eight vents they may be 45 degrees apart etc. The present invention may help to ensure that there is a reliable connection (i.e. bearing surface) between the underside of the wellhead support structure and the waterbed. This may be achieved because a flowable settable material, e.g. cement, is provided in the gap underneath the wellhead support structure after the drilling of the hole has been completed. The settable material may be provided underneath the wellhead support structure after or at the same time as the casing has been fixed into the seabed. This means that the settable material may fill any holes or area of soil washout that may have occurred around the hole that has been formed and thus ensure that there is a good load path for forces to be transferred from the wellhead support structure into the waterbed.

The waterbed underneath the wellhead support structure may be dredged before the settable material is provided to fix the wellhead support structure onto the seabed. This may help improve the horizontal capacity of the bearing surface underneath the wellhead support structure. This may mean that lateral and bending loads applied to the wellhead assembly (e.g. to the wellhead housing from subsea riser equipment) can be absorbed into the seabed more effectively.

Dredging may also be used to reduce the unevenness of the seabed where the assembly is being fixed and/or result in it having a reduced slope, e.g. a slope of 3 degrees from horizontal or less.

The set material between the wellhead support structure and the waterbed may extend from the outside surface of the well casing (towards the centre of the assembly) to the outer perimeter of the wellhead support structure (towards the outside of the assembly). The material may be in contact with the majority (e.g. more than 50%, 70%, 80%, or 90%) of the underside of the wellhead support structure. This may help to ensure that loads can be transferred effectively into the seabed from the wellhead housing.

The well casing may be any well casing that is directly fixed to the waterbed, i.e. there may be no further casings outside of the well casing. The well casing may be a conductor casing (which may also be referred to as a low pressure casing), a high pressure casing and/or a pipe that is hung off/directly attached to the wellhead support structure. The well casing may be a 30", 36" or 42" conductor casing for example.

The wellhead housing may be a high pressure wellhead housing. This may be a wellhead housing onto which subsea riser system equipment, such as a Christmas tree and/or BOP, is mounted and/or latched. The wellhead housing may be a conductor housing that is for receiving a high pressure wellhead housing.

If the wellhead housing is a high pressure housing and the well casing is a conductor casing the high pressure housing may be indirectly connected to the conductor casing via a conductor (i.e. low pressure) housing. The high pressure housing may support a high pressure casing that runs inside the conductor casing.

The wellhead support structure may have an outer diameter that is larger than the outer diameter of the well casing. For example, the diameter of the wellhead support structure may be at least two times, three times, four times, five times, ten times or twenty times the diameter of the wellhead casing. This may help to ensure that the wellhead support structure significantly increases the contact area between the assembly and the seabed.

The assembly may comprise a wellhead housing receptacle. The wellhead housing receptacle may be part of, integral with, fixed and/or welded to the wellhead support structure.

The wellhead housing receptacle may be for receiving the wellhead housing. The wellhead housing may be located and/or locked into the housing receptacle. The assembly for example may comprise a locking ring that is bolted to the top of the receptacle and/or support structure to lock the wellhead housing into the receptacle.

The receptacle may comprise an adaptor ring inside the receptacle. The adaptor ring may be changed depending on the size or geometry of the wellhead housing to be received in the receptacle. The receptacle may be connected to the housing via the adaptor ring and the locking ring.

The well casing may be fixed directly to the bottom of the housing receptacle. The well casing may be fixed directly to the bottom of the wellhead housing received in the receptacle.

The housing receptacle and/or wellhead support structure (depending on whether the receptacle is present) may contact the wellhead housing at at least two axially separated circumferential locations. This is to ensure that bending moments applied to the wellhead housing can be transferred into the wellhead support structure. The axially separated circumferential locations may for example be located with one towards one end of the wellhead housing and the other towards the other end of the wellhead housing. The housing may be contacted over a majority, such as its entire, length. This is to try to ensure that forces can be effectively transferred into the wellhead support structure.

The assembly may comprise a bearing surface for the wellhead support structure from or near the outside of the well casing to or near the outer perimeter of the wellhead support structure.

Because the assembly is arranged so that bending moments applied to the wellhead housing can be at least partially transferred to the waterbed via the wellhead support structure, the amount of force transferred from the wellhead housing to the well casing may be reduced.

Forces applied to the wellhead housing, e.g. from the subsea riser system, may be transferred to the seabed via both the wellhead support structure and the well casing. Thus there may be a combined bearing capacity through both the wellhead support and the well casing rather than all forces being directed to seabed via the well casing.

The wellhead support structure may comprise a plurality of beams, such as I beams, that extend out radially from the well casing and/or wellhead housing. The beams may be fixed onto a plate. This plate may help ensure that there is a good surface under which the settable material can be supplied to fix the wellhead support structure onto the surface of the seabed. The plate may provide the top surface of the bound volume in which the settable material is provided underneath the wellhead support structure.

In the present description the terms "subsea" and "seabed" etc may be used. However, this invention is equally applicable in other bodies of water other than the sea such as an ocean, lake, river, etc. These terms should thus not be understood as only referring to scenarios in which the body of water is the sea but instead any body of water at the bottom of which a well can be located. The term waterbed herein may be a seabed.

Certain preferred embodiments of the present invention will now be described by way of example only with reference to the accompanying drawings, in which.

Figure 3A:
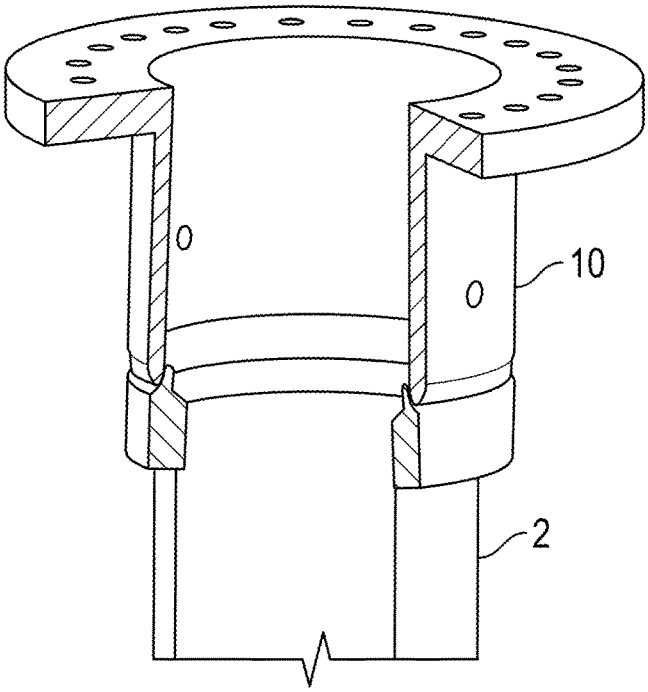
Figure 3B:
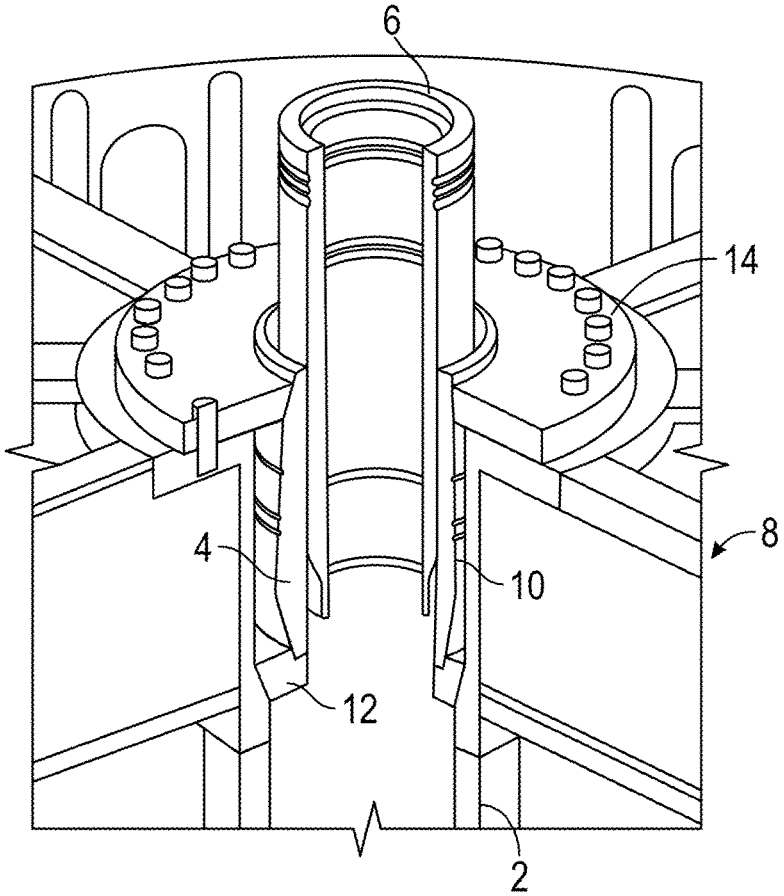
Figure 5:
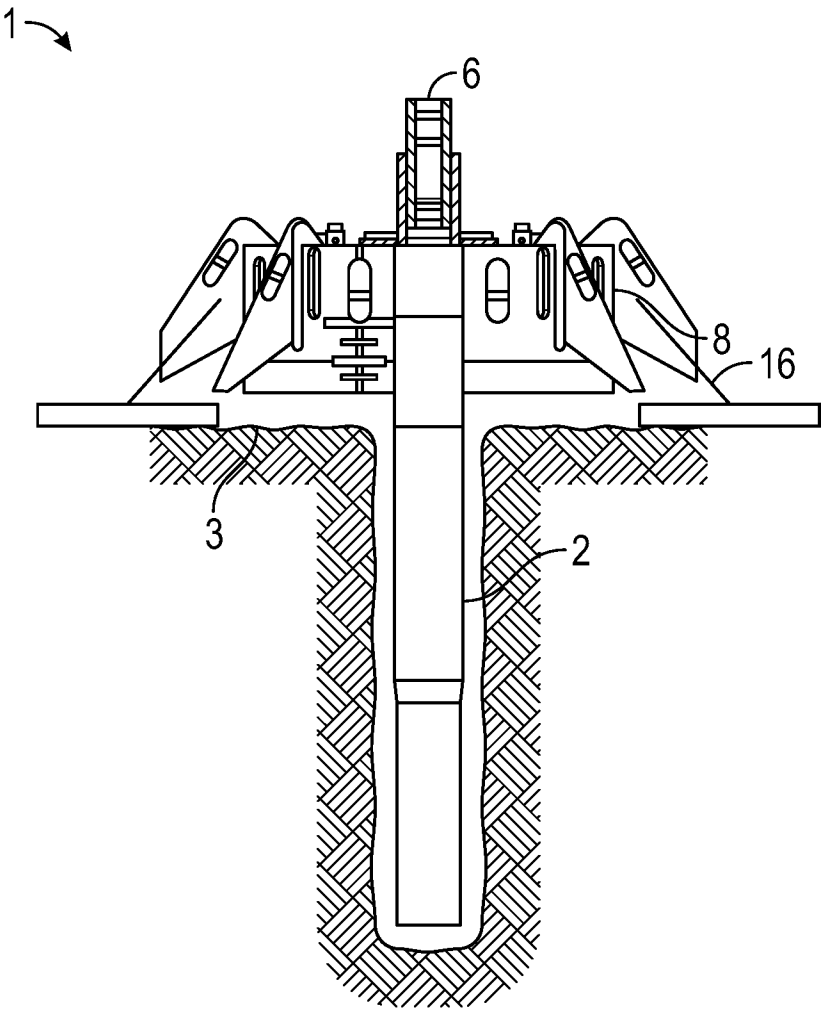
Figure 4:
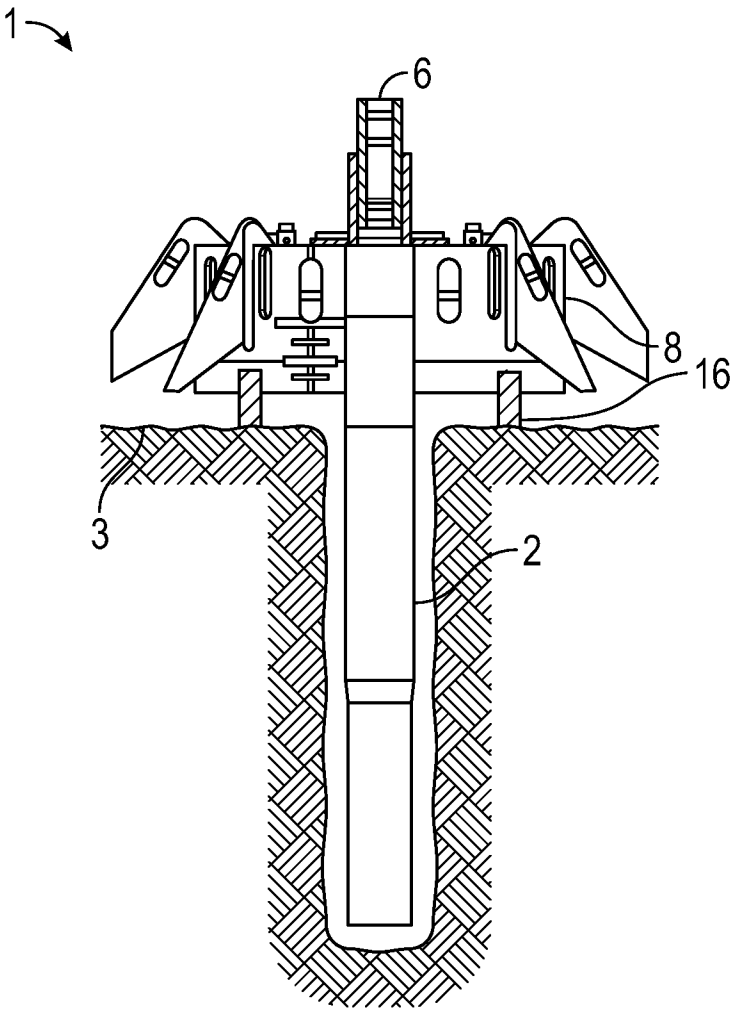
Figure 7:
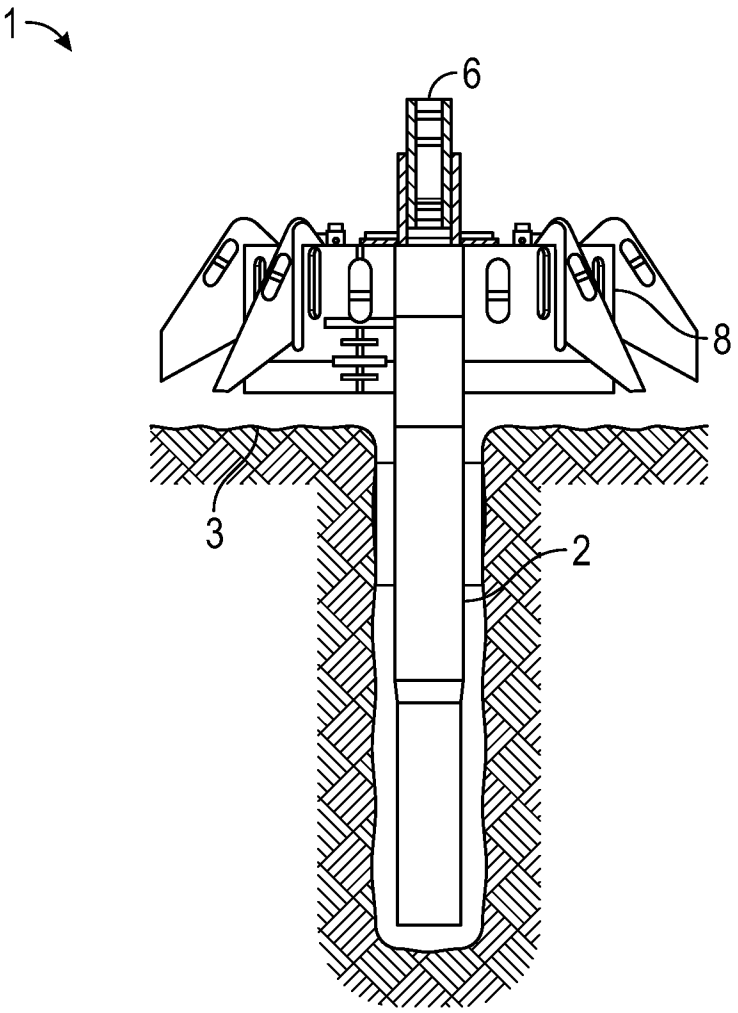
Figure 6:
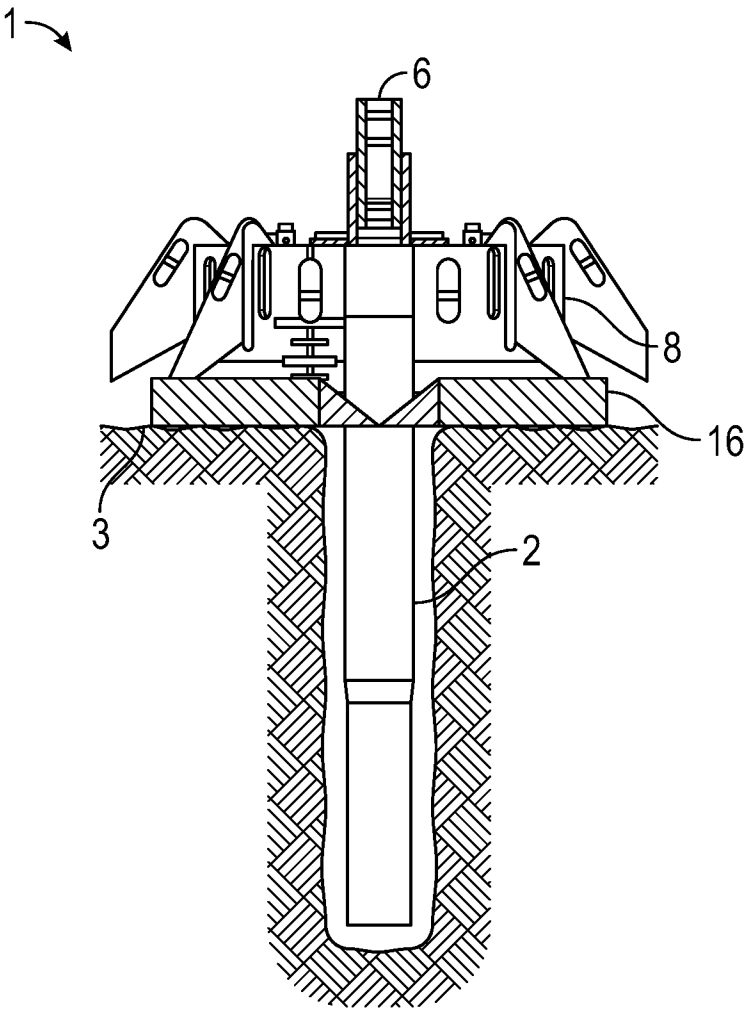
Figure 9:
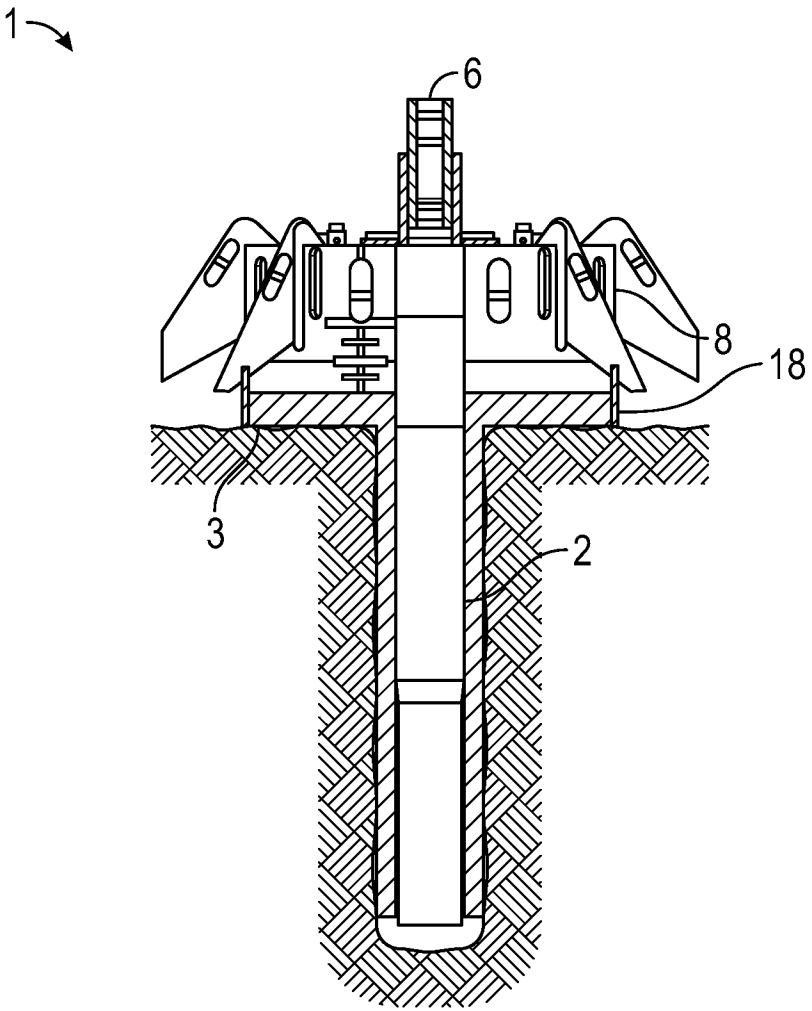
Figure 8:
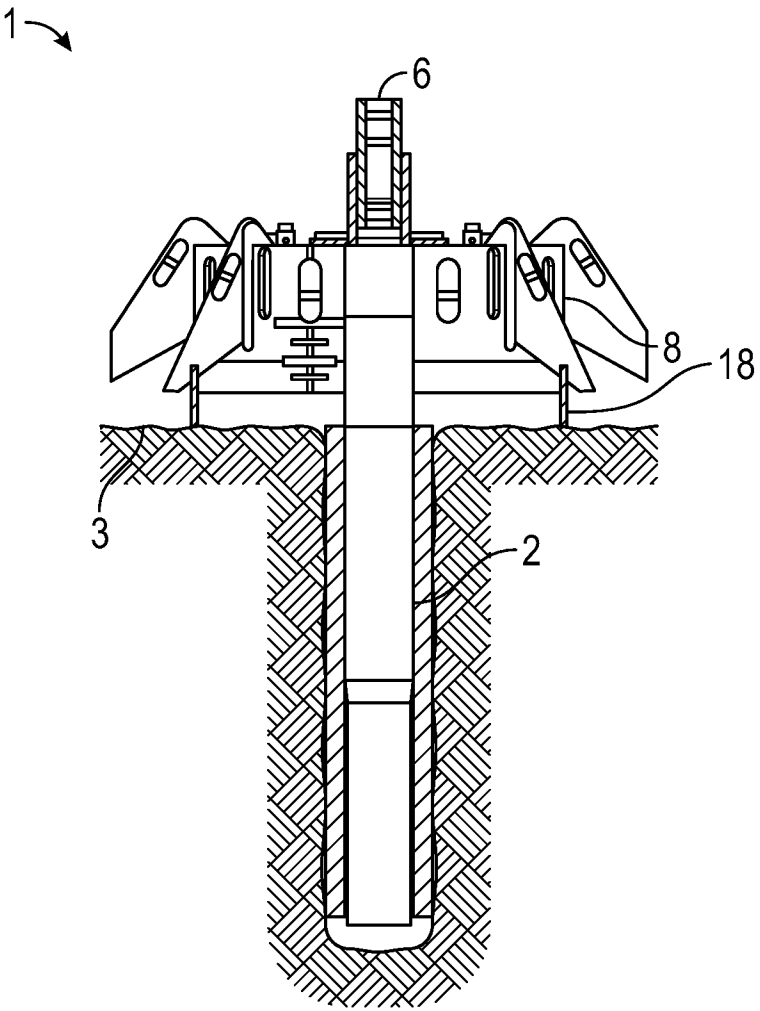
Figure 11:
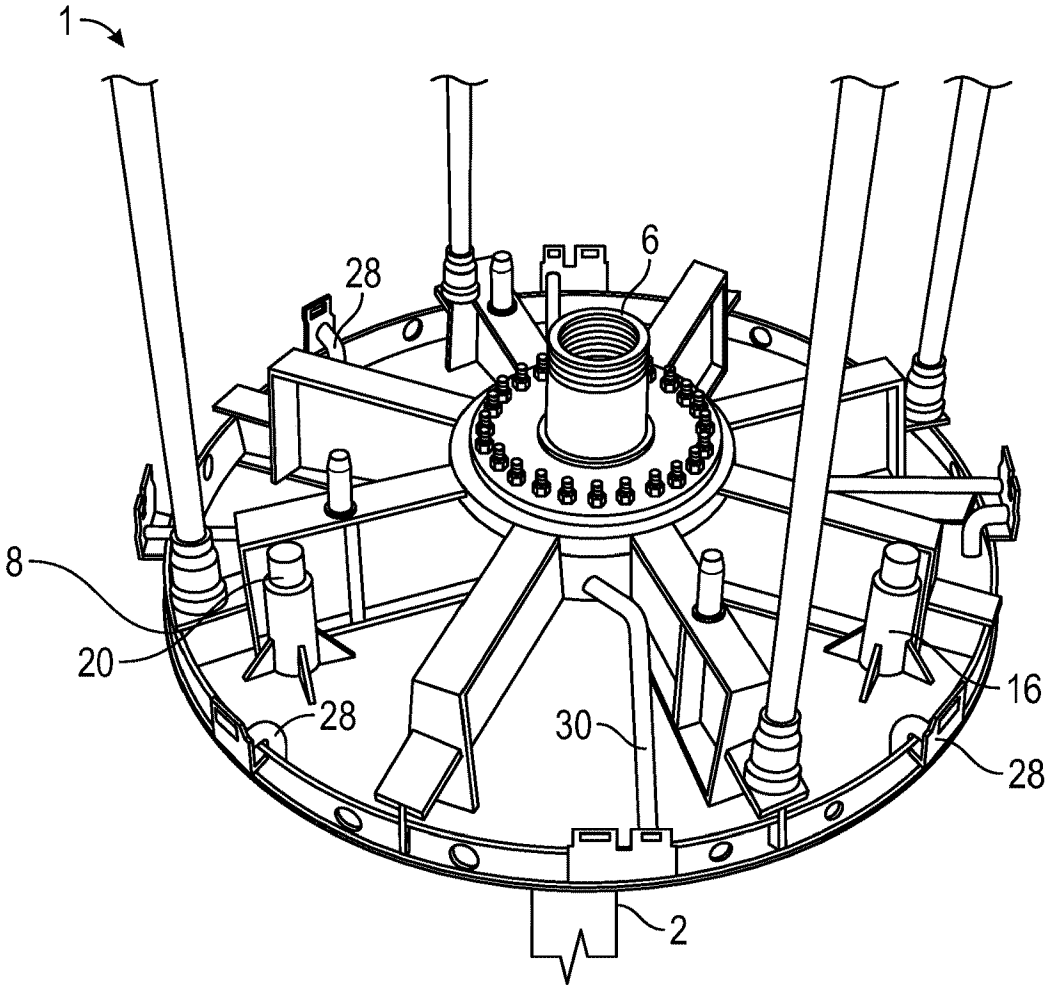
Figure 10:
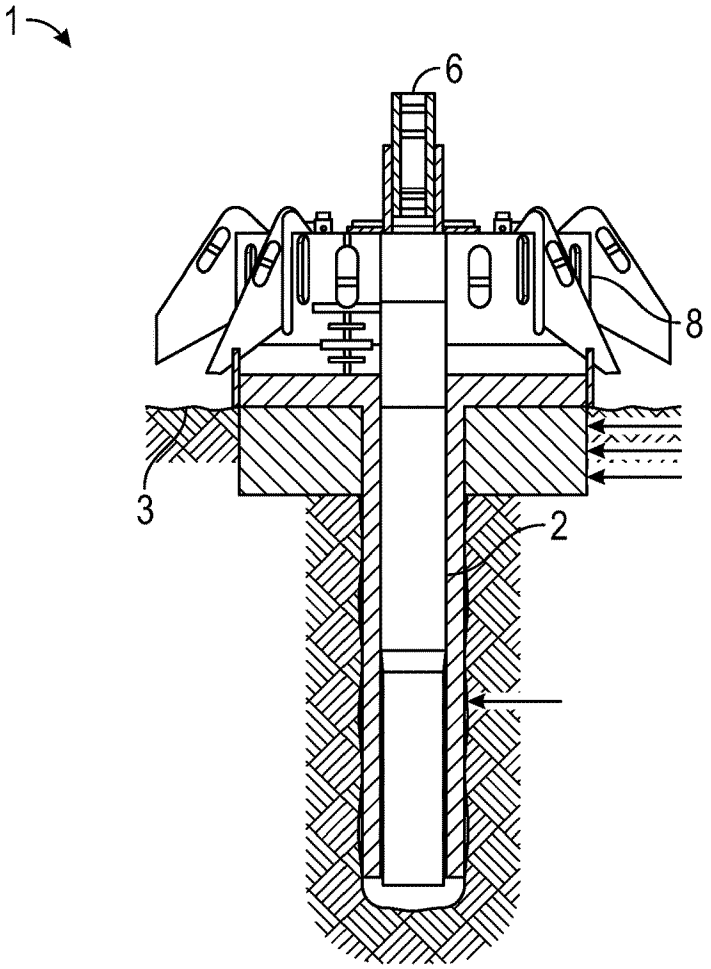
Figure 12:
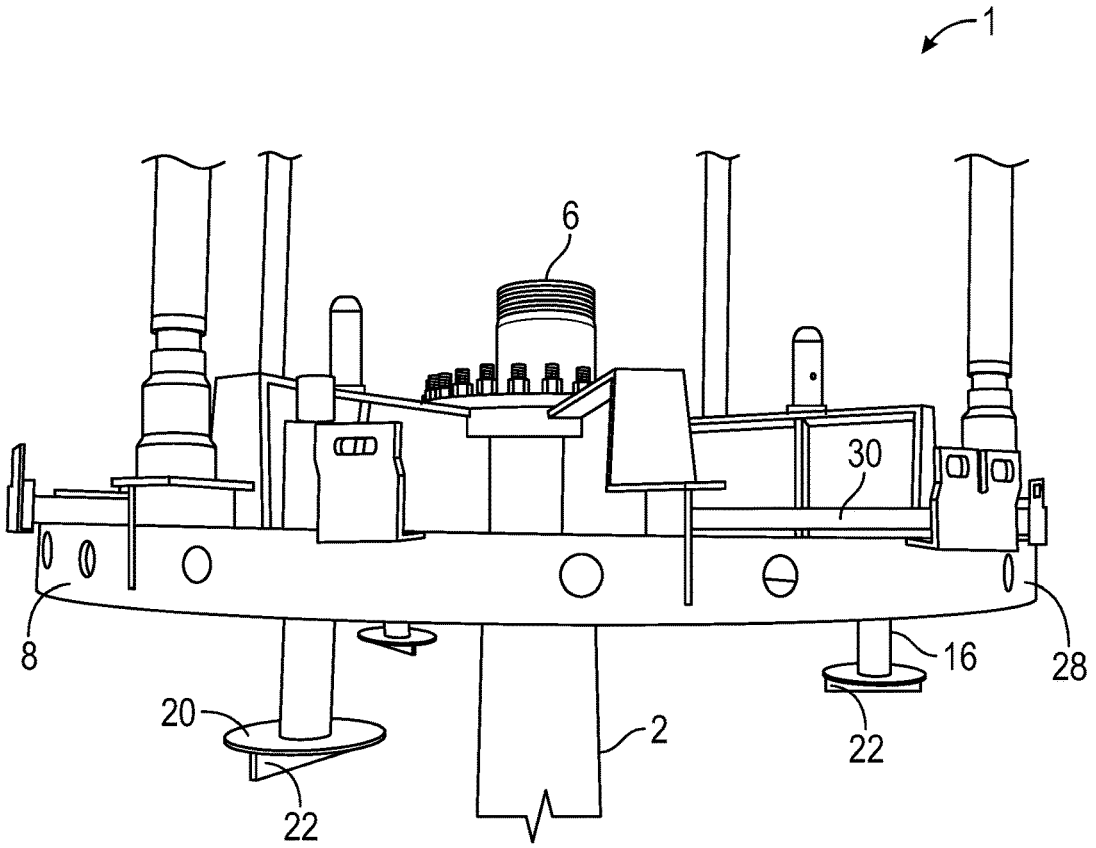
Figure 13:
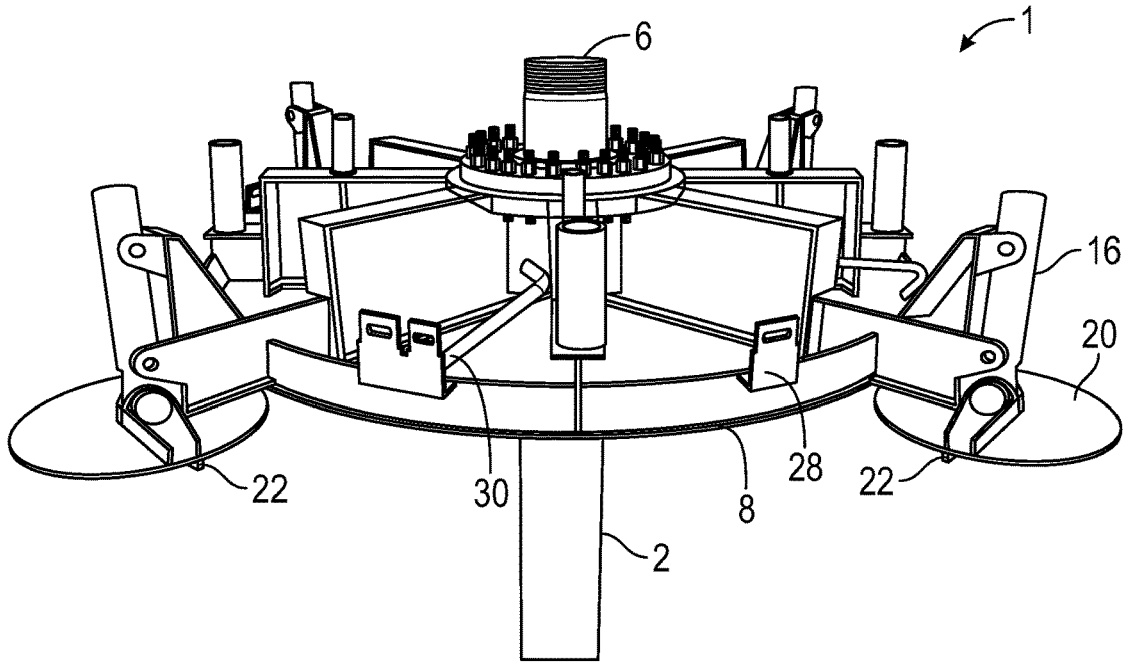
Figure 14A:
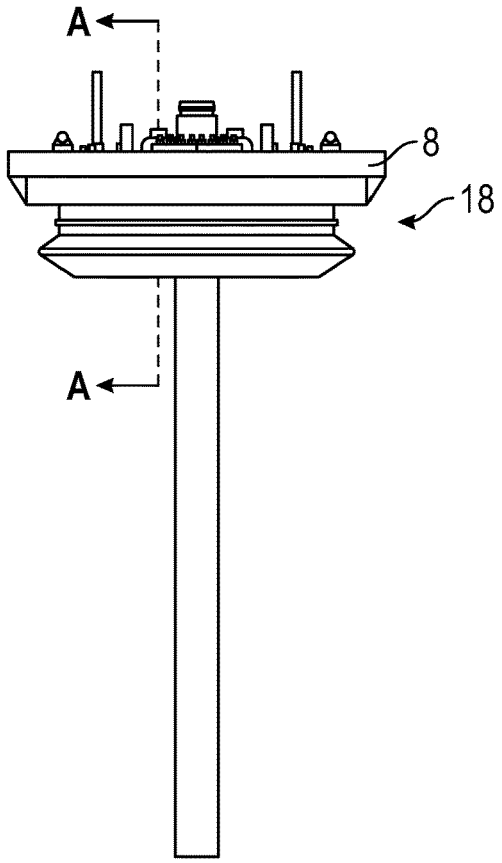
Figure 14B:
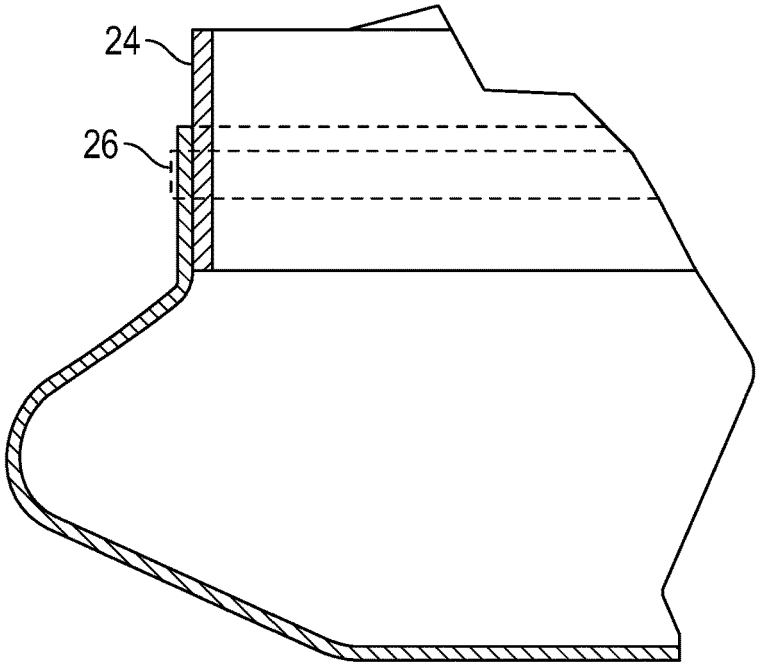
Figure 15:
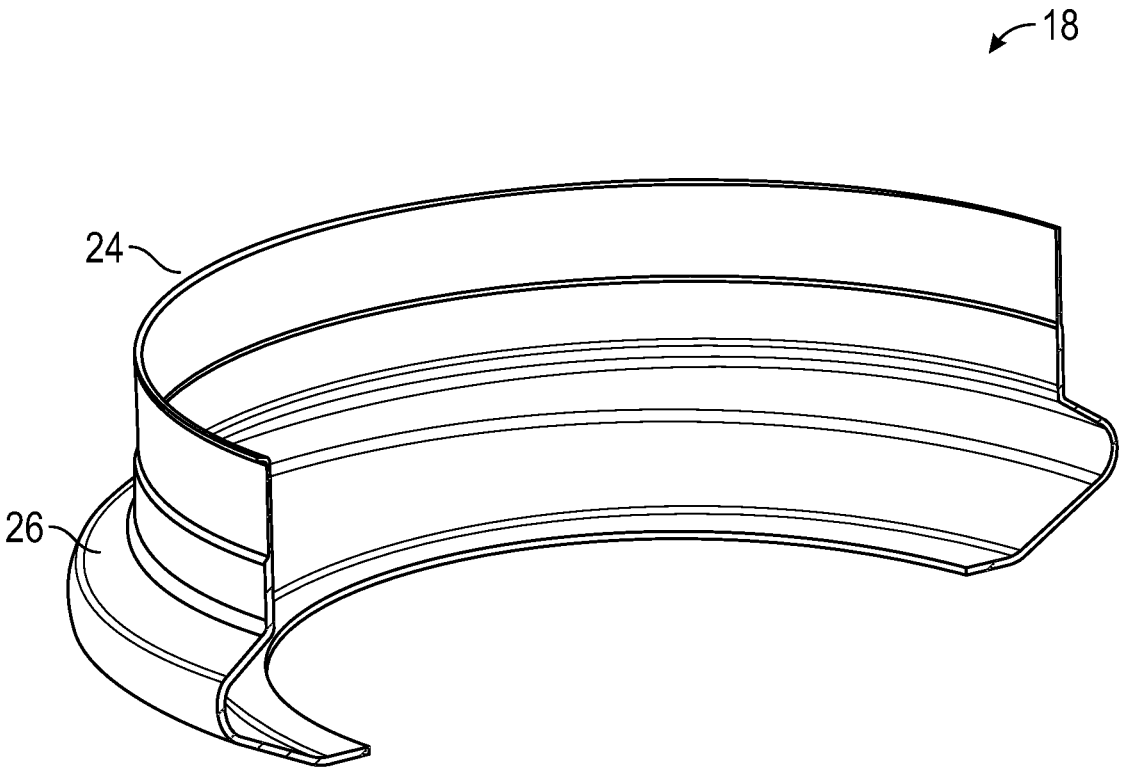

FIGS. 3*a* and 3*b* show details of a wellhead housing receptacle;

FIGS. 4, 5 and 6 show the wellhead support structure with different mounts between the wellhead support structure and the seabed;

FIG. 7 shows the assembly supported by a packer;

FIG. 8 shows the assembly during installation when the well casing is fixed in the seabed;

FIG. 9 shows the assembly with the well casing fixed in the seabed and the wellhead support structure fixed onto the surface of the seabed;

FIG. 10 shows an embodiment which the seabed has been dredged underneath the wellhead support structure and then fixed onto the dredged surface, FIGS. 11 and 12 shows an assembly with another type of mount, FIG. 13 shows an assembly with yet another type of mount, FIGS. 14*a* and 14*b* illustrate an assembly with a barrier, and FIG. 15 shows the barrier in more detail.

The present invention concerns a subsea wellhead assembly 1 that is designed specifically for use in hard soils and is designed so as to try to minimise the problem of soil washout underneath the wellhead support.

The assembly comprises a well casing (in this case a conductor casing) 2 connected to a conductor housing (also referred to as a low pressure conductor housing) 4 in which is mounted a high pressure wellhead housing 6.

In use (although not shown in any of the figures), wellhead components such as a blowout preventer (BOP) are mounted and/or latched on the high pressure wellhead housing 6. These can result in a bending moment being applied to high pressure wellhead housing 6 that is ultimately transferred to the seabed (or any other waterbed where a well may be located) 3 via the conductor casing 2. This can cause damage to the conductor casing 2 if the forces applied to the conductor casing 2 are too large.

To reduce the forces applied to the conductor casing 2 a wellhead support structure 8 is provided. This wellhead support structure 8 provides another load path for forces to be transferred to the seabed 3 rather than all of the forces going through the conductor casing 2. The wellhead support structure 8 is rigidly connected to the conductor casing 2 and the conductor housing 4 and the high pressure wellhead housing 6.

FIGS. 3*a* and 3*b* show one option for an arrangement to connect the components of the assembly together. In this option the assembly comprises a well housing receptacle 10. As shown in FIG. 3*b* the housing receptacle 10 is fixed to or integral with the beams of the wellhead support structure 8. The well casing 2 is fixed to the bottom of the receptacle 10. The conductor housing 10 is located in the conductor housing on an adaptor ring 12 and locked in place by a locking ring 14 that is bolted to the top of the receptacle 10 and/or wellhead support 8.

The adaptor ring 12 may be interchangeable so that a standard sized receptacle 10 can be adjusted to be able to receive various sized and shaped wellhead housings 4, 6. Similarly the locking ring 14 may be customised as required to secure various sized and shaped wellhead housings 4, 6.

The connector arrangement shown in 3*b* can provide a rigid connection between the components that allows lateral and bending moments to be efficiently transferred from the high pressure wellhead housing 6 into the conductor housing 4 into the receptacle 10 and then into the support structure 8 before ultimately being transferred into the seabed 3.

The wellhead support structure 8 is cemented (i.e. grouted) onto the seabed 3 as shown in FIGS. 9 and 10.

Figure 2:
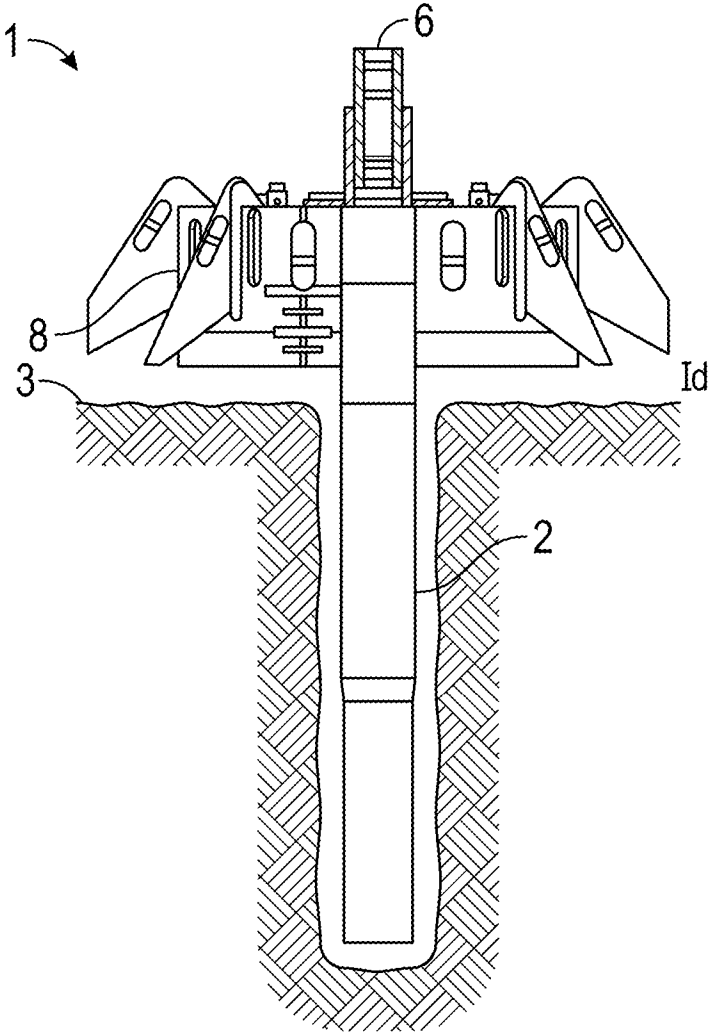
FIG. 2 shows the assembly located so that the well casing is in the hole and the wellhead support structure is above the surface of the seabed.
Figure 1:
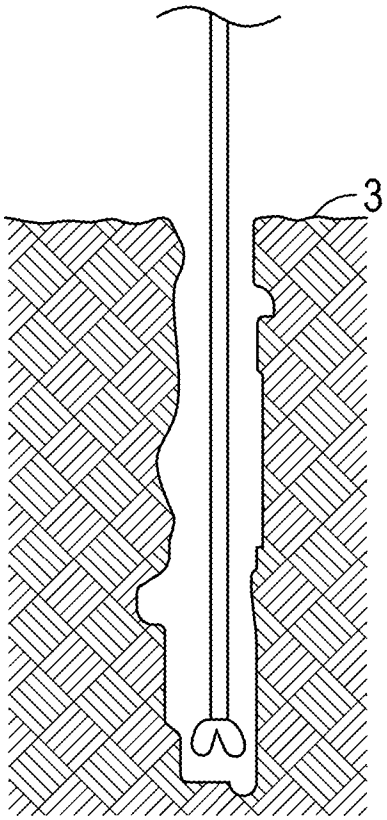
FIG. 1 shows the drilling of a pilot hole.

In the installation procedure first a hole is drilled in the hard seabed 3 as shown in FIG. 1. Then the conductor casing 2 with the rigidly connected wellhead support structure 8 is located so that the conductor casing 8 is within the drilled hole and the wellhead support structure 8 is located a small distance d above the seabed 3.

Cement is provided to fill the gap between the conductor casing 2 and the drilled hole in the seabed 3. The cement once cured rigidly connects the conductor casing 2 to the seabed 3. The assembly is held vertical and/or levelled whilst the cement between the conductor casing 2 and the drilled hole in the seabed 3 cures. The assembly may also be held vertical and/or levelled before the cement is provided into the hole 3. This may be achieved by holding the assembly 1 via a drill string, using a packer and/or some support/mount (i.e. levelling device) 16 between the wellhead support structure 8 and the seabed 3. The mount 16 may for example be hydraulic jacks or sliding cylinders as schematically shown in FIG. 4 and as shown in FIG. 13, hydraulic feet as shown in FIG. 5, a gimble as illustrated in FIG. 6 and/or levelling screws as shown in FIGS. 11 and 12.

Cement may then be supplied to fill the void (i.e. gap) between the seabed 3 and the underside of the wellhead support structure 8. As shown for example in FIGS. 8 and 9, a mould 18 such as a sliding ring or skirt protruding from the bottom of the support structure 8 around the outside of the wellhead support structure or an inflatable packer may be provided as a containment for the cement so as to ensure proper filling of the void underneath the wellhead support structure 8.

Forces can thus be transferred from the high pressure wellhead 6 to the wellhead support structure 8 and then into the seabed 3 via the cement underneath the wellhead support structure 8.

The seabed 3 underneath the wellhead support structure 8 may be dredged as shown in FIG. 10. This may provide a larger void between the underside of the wellhead support structure 8 and the top of the seabed 3 so that the cured cement can effectively extend slightly above the upper most surface of the seabed 3. As illustrated by the three arrows on the right hand side of FIG. 10, this may allow the horizontal capacity of the cement underneath the wellhead support structure 8 to be increased.

FIGS. 11 and 12 show another wellhead assembly 1 that comprises a plurality (specifically in this case three) mounts 16 in the form of levelling screws. These screws 16 are provided on and through the wellhead support structure 8. Each screw has an ROV torque tool 20 at the upper end thereof. This allows the length of each screw 16 to be adjusted independently by an ROV once the well casing 2 is located in the hole in the seabed.

FIG. 13 shows another well assembly 1 that comprises a number (in this case four) mounts 16 in the form of hydraulic levelling cylinders.

As shown in FIGS. 12 and 13, each of the mounts has a pad 20 that contacts the waterbed. Each pad 20 has a bar 22 on its underside that is used to increase the friction between the mount 16 and the seabed so as to reduce the risk of the mount 16 and hence assembly 1 slipping on the seabed.

The mounts 16 are used to hold the wellhead support structure 8 a distance from the seabed to provide a gap/volume underneath the wellhead support structure 8 which can be filled with a settable material such as cement.

Each of these assemblies 1 may be levelled and held in a stable position by the mounts 16 after the well casing 2 has been located in a hole in the seabed.

This may allow the assembly 1 to be fixed in the desired orientation and held stably to allow the settable material to cure and form a reliable bond between the well casing 2 and the seabed.

Although not shown in FIGS. 11, 12 and 13, these assemblies 1 may be used with a barrier 18 that is used to form a closed volume underneath the wellhead support structure 8 in which the settable material is supplied.

The barrier 18 may be as shown in FIGS. 14*a*, 14*b* and 15.

FIG. 14*b* shows a cross section through a portion of the barrier 18 shown in FIG. 14*a*.

FIG. 15 shows the barrier 18 when it is not attached to the wellhead support structure 18.

This barrier 18 comprises a rigid upper portion 24, e.g. a steel ring, and a flexible lower portion 26. The rigid upper portion 24 may be fixed to the wellhead support structure 8. The flexible lower portion 26 may be fixed to the rigid upper portion 24 and may in use seal against the seabed. The flexible lower portion may have a weighted lower edge, e.g. weighted with a chain, sand and/or any other heavy materials, so that it seals against the seabed.

The seabed, barrier 18 and underside of the wellhead support structure 8 may together define a gap (i.e. volume) which during installation is filled with a settable material such as cement. The settable material sets to form a rigid connection between the seabed 3 and the underside of the wellhead support structure 8.

It is desired for the settable material to entirely fill the gap (i.e. fill the majority of the volume aside from unavoidable air or water pockets).

The method of installing the assembly 1 comprises verifying that the settable material has filled the gap within the barrier 18. This is achieved by the assembly 1 having a plurality of vents 28 that extend through the wellhead support structure 8 into the volume underneath. In the assemblies 1 shown in FIGS. 11, 12 and 13 there are eight such vents 28 as best seen in FIG. 11.

The method may comprise filling the gap underneath the wellhead support structure 8 within the barrier 18 with a settable material such as cement, until the settable material is returned through one or more or all of the vents 28.

Additionally and/or alternatively the vents 28 and/or additional vents not shown in the figures that extend into the gap, e.g. through the wellhead support structure may be used to supply the settable material into the gap. This may be alternatively or additionally to filing the gap with settable material provided through the well casing.

The assembly 1 may also comprise a plurality of cement return lines 30 connecting to an annulus within the well casing that is filled with cement as is known in subsea wellhead installations. Because the assembly is arranged so that bending moments applied to the wellhead housing 4, 6 can be at least partially transferred to the seabed 3 via the wellhead support structure 8, the amount of force transferred from the wellhead housing 4, 6 to the well casing 2 may be reduced. Further, given that the wellhead support structure 8 is cemented onto the seabed 3 after the hole has been drilled and the conductor casing has been located in the seabed, a reliable bearing surface may be ensured underneath the wellhead support structure 8 even in hard soils.

The invention claimed is:

1. A method of installing a wellhead assembly on a waterbed, the wellhead assembly comprising a well casing and a wellhead support structure, the method comprising:

providing the well casing;

providing the wellhead support structure;

locating and fixing the well casing in a hole in the waterbed, wherein when the well casing is located and fixed in the hole, the wellhead support structure is located a distance above the waterbed so as to leave a gap between the surface of the waterbed and an underside of the wellhead support structure; and fixing the wellhead support structure onto the surface of the waterbed with a settable material by putting the settable material into the gap when in a non-solid state and allowing it to solidify to provide a rigid connection between the waterbed and the underside of the wellhead support structure, wherein there is direct contact between the settable material and the underside of the wellhead support structure and between the settable material and the surface of the waterbed underneath the wellhead support structure, wherein the assembly is arranged so that bending moments applied to the wellhead assembly can be at least partially transferred to the waterbed via the wellhead support structure.

2. A method according to claim 1, wherein the well casing is held in a position by holding the wellhead support structure whilst the well casing is being fixed in the hole.

3. A method according to claim 2, wherein the well casing is held in the position using a mount between the wellhead support structure and the waterbed.

4. A method according to claim 3, wherein the mount is an adjustable mount.

5. A method according to claim 1, wherein the method comprises providing a barrier to provide a bound volume between the surface of the waterbed and the support structure in which the settable material is provided.

6. A method according to claim 1, wherein the settable material is in contact with the majority of the underside of the wellhead support structure.

7. A method according to claim 1, wherein the wellhead support structure is fixed onto the surface of the waterbed after the wellhead support structure has been connected to the well casing.

8. A method according to claim 1, wherein the method comprises forming a hole in the waterbed for the well casing.

9. A method according to claim 8, wherein fixing the wellhead support onto the surface of the waterbed occurs after the hole has been formed in the waterbed.

10. A method according to claim 8, wherein the wellhead support structure and well casing are connected together before the well casing is fixed in the hole in the waterbed.

11. A method according to claim 1, wherein the waterbed underneath the wellhead support structure is dredged before the settable material is provided to fix the wellhead support structure onto the waterbed.

12. A method according to claim 1, wherein the waterbed comprises hard soil.

13. A method according to claim 1, wherein no component of the wellhead assembly is forced into the waterbed.

14. A wellhead assembly comprising:

a well casing connected to a wellhead housing, wherein the well casing is fixed into a waterbed; and a wellhead support structure connected to the wellhead housing, wherein the wellhead support structure is located a distance above the waterbed so as to provide a gap between the surface of the waterbed and an underside of the wellhead support structure, and the wellhead support structure is fixed onto the surface of the waterbed using a settable material that has been put into the provided gap when in a non-solid state and allowed to solidify to provide a rigid connection between the waterbed and the underside of the wellhead support structure, wherein there is direct contact between the settable material and the underside of the wellhead support structure and between the settable material and the surface of the waterbed underneath the wellhead support structure, and wherein the wellhead support structure is arranged so that bending moments applied to the wellhead housing can be at least partially transferred to the waterbed via the wellhead support structure.

15. A wellhead assembly according to claim 14, wherein the assembly is installed according to a method comprising:

locating and fixing the well casing in a hole in the waterbed, wherein when the well casing is located and fixed in the hole the wellhead support structure is located a distance above the waterbed so as to leave a gap between the surface of the waterbed and the underside of the wellhead support structure; and fixing the wellhead support structure onto the surface of a waterbed with a settable material by putting the settable material into the gap when in a non-solid state and allowing it to solidify to provide a rigid connection between the waterbed and the underside of the well-head support structure.

* * * * *